US005799898A

United States Patent [19]

Sumida et al.

[11] Patent Number: 5,799,898

[45] Date of Patent: Sep. 1, 1998

[54] WEB WINDING APPARATUS

[75] Inventors: Kunihiro Sumida; Hiroki Sato, both of Kanagawa-ken, Japan

[73] Assignee: Fuji Photo Film Co., Ltd., Kanagawa, Japan

[21] Appl. No.: 725,765

[22] Filed: Oct. 4, 1996

[30] Foreign Application Priority Data

Oct. 5, 1995 [JP] Japan ..... 7-258584

[51] Int. Cl.[6] ..... B65H 18/08

[52] U.S. Cl. ..... 242/530.1; 242/533.7

[58] Field of Search ..... 242/530.1, 530.3, 242/530.4, 533.7

[56] References Cited

U.S. PATENT DOCUMENTS

| | | | |
|---|---|---|---|
| 2,553,052 | 5/1951 | Kwitek | 242/530.1 X |
| 2,652,208 | 9/1953 | Fitch | 242/530.1 X |
| 3,990,646 | 11/1976 | Salgo | 242/533.7 X |
| 4,063,692 | 12/1977 | Buggy | 242/530.3 |
| 4,391,415 | 7/1983 | Hollier, Jr. | 242/530.1 X |
| 4,422,588 | 12/1983 | Nowisch . | |
| 4,611,769 | 9/1986 | Orbach | 242/530.4 |
| 4,993,654 | 2/1991 | Suzuki et al. | 242/530.1 |
| 5,352,319 | 10/1994 | Ishizu et al. | 242/530.1 X |
| 5,464,168 | 11/1995 | Baker et al. | 242/530.1 |

FOREIGN PATENT DOCUMENTS

| | | |
|---|---|---|
| 0360948 | 4/1990 | European Pat. Off. . |
| 3703599 | 8/1988 | Germany . |

*Primary Examiner*—John M. Jillions
*Assistant Examiner*—William A. Rivera
*Attorney, Agent, or Firm*—Sughrue, Mion, Zinn, Macpeak & Seas, PLLC

[57] ABSTRACT

A web winding apparatus for taking up a web in a predetermined width by rotating a core in a predetermined length in a winding section includes a core cutting section which cuts a core in the predetermined length from a core material. A core conveyor directly couples the core cutting section to the winding section and transfers the core cut in the core cutting section to the winding section.

4 Claims, 3 Drawing Sheets

WEB WINDING APPARATUS

BACKGROUND OF THE INVENTION

1. Field of the Invention

This invention relates to the web winding apparatus for taking up web in a continuous length around a core such as a paper tube, and more particularly to a web winding apparatus which can prevent fluctuation in the length of the core due to influence of the temperature and/or humidity.

2. Description of the Related Art

For example, in the manufacture of photographic photosensitive material, there has been in wide use a web winding apparatus in which a web in a continuous length and a predetermined width is taken up around a core by rotating the core in a winding section. As one of the such web winding apparatuses, there has been known an apparatus in which a wide web is slit into a plurality of webs of a predetermined width and the slit webs in continuous lengths are taken up around a plurality of cores supported on one spindle side by side.

FIG. 4A shows a state where webs 2*a* to 2*e* in continuous lengths have been taken up around cores 1*a* to 1e by such a single-spindle type web winding apparatus.

In the single-spindle type web winding apparatus, cores having a length equal to or slightly larger than the width of the slit web are generally used. It is very important for the cores to be accurate in the length (dimension in the direction of width of the web).

For example, if the cores are longer than a predetermined length, there is a fear that the webs are taken up around some of the cores in positions shifted relative to the respective cores as shown in FIG. 4B, which results in the deterioration in appearance of the products. Further the web winding apparatus is generally provided with a chucking means for chucking the cores on the spindle. Inaccuracy in the lengths of the cores can cause failure in the chucking means.

These problems can occur also when the cores are shorter than the predetermined length, and not only when the slit webs are taken up around a plurality of cores supported on one spindle side by side but also when the slit webs are taken up around a plurality of cores on a plurality of spindles out of alignment with each other and when a web in a continuous length is taken up around a core.

Paper tubing is often employed as the core and the problems described above are especially apt to occur when a paper tube is used. That is, even if a paper tube is accurately cut in a predetermined length, the length of the tube often has been deviated from the predetermined length due to influence of the temperature and/or humidity by the time the paper tube is actually used in taking up a web.

In the case where the web is a photosensitive material such as printing paper, and a side edge of the photosensitive material roll projects outward beyond the edge of the core, the side edge portion of the photosensitive material is apt to be folded near the core. When the side edge portion of a photosensitive material is folded, the photosensitive material generally cannot be used, which results in a substantial economical loss.

Accordingly, conventional paper cores as delivered to a web winding plant are used after being subjected to moisture conditioning to make the paper cores into a proper length. However this gives rise to a problem that a large moisture conditioning zone is necessary in the plant or the temperature and relative humidity in the plant must be carefully controlled, which adds to the cost of the products.

Further, an attempt to suppress change in the dimensions of the paper cores by packing paper cores in a highly moistureproof fashion adds to the cost of the paper cores and the unpacking load is increased to deteriorate working efficiency.

SUMMARY OF THE INVENTION

In view of the foregoing observations and description, the primary object of the present invention is to provide a web winding apparatus which can prevent change of the dimensions of cores of paper tubes or the like due to the influence of the temperature and relative humidity.

In accordance with the present invention, there is provided a web winding apparatus for taking up a web in a predetermined width by rotating a core in a predetermined length in a winding section said apparatas comprising

- a core cutting section which cuts a core in said predetermined length from a core material, and a winding section which winds the web around the core,
- a core transfer means which directly couples the core cutting section to the winding section and transfers the core cut in the core cutting section to the winding section.

The expression that the core transfer means directly couples the core cutting section to the winding section means that the core transfer means directly transfers the core from the core cutting section to the winding section without staying the core in any other place such as a core storage zone.

The web winding apparatus of the present invention is especially useful when the core is of a paper tube.

In one embodiment of the present invention, the web winding apparatus is arranged so that a wide web is slit into a plurality of webs of a predetermined width and the slit webs in continuous lengths are taken up around a plurality of cores supported on one spindle side by side.

In such an embodiment, it is preferred that the core transfer means be arranged so that the number of the cores which can be loaded on the transfer means at one time is not larger than three to four times the number of the cores which can be loaded in the winding section at one time.

The web winding apparatus of the present invention is especially useful when the web is a photosensitive material.

In the web winding apparatus of the present invention, the core cut into a predetermined length in the core cutting section is directly transferred to the winding section without staying in any other place, and the core can be used before the dimensions of the core largely change due to influence of the temperature and relative humidity. Accordingly, the problems described above caused by inaccurate length of the core, e.g., deterioration in appearance of the product, failure in the chucking means and the like, can be overcome.

Further since the length of the core can be kept accurate, adjustment for ensuring regular winding of the web can be eliminated or greatly facilitated.

Neither a moisture conditioning zone for storing cores, nor packing of paper cores in a highly moistureproof fashion is necessary, such that cost for coping with change in the dimensions of the cores can be omitted.

When the core is made of paper which is more sensitive to the influence of temperature and humidity, the present invention is more effective.

In the case where the slit webs in continuous lengths are taken up around a plurality of cores supported on one spindle side by side, inaccuracy in the dimensions of the cores involves more serious problems as described above and accordingly the present invention is more effective.

In order to suppress the influence of the temperature and humidity, the number of the cores which can be loaded on the transfer means at one time should be as small as possible. In other words, the core transfer path along which the cores are transferred to the winding section should be as short as possible. However in order to ensure a walking space for the operator, the core transfer path is generally positioned overhead. Even in such a case, the core transfer means should not be longer than the length necessary for loading at one time, three to four times the number of the cores which can be loaded in the winding section.

Further when the webs are taken up around the cores in positions shifted relative to the respective cores, the resultant economical loss is large in the case where the web to be taken up is a photosensitive material. Accordingly the present invention is more effective.

DESCRIPTION OF THE PREFERRED EMBODIMENT

Figure 1:
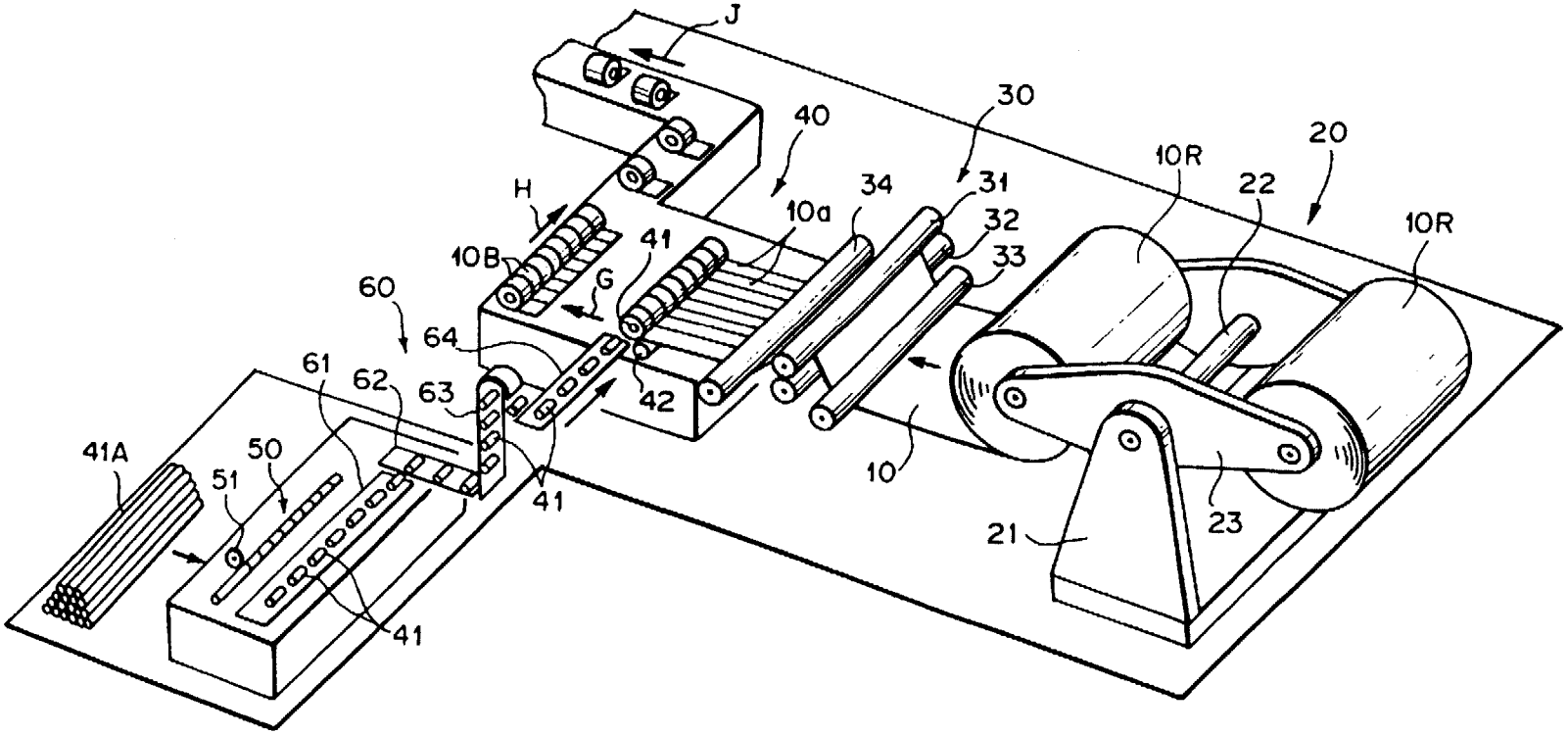
FIG. 1 is a perspective view of a web winding apparatus in accordance with an embodiment of the present invention.

In FIG. 1, a web winding apparatus in accordance with an embodiment of the present invention comprises a feed-out mechanism 20 which holds a roll 10R of a wide web 10 of printing paper and rotates the wide web roll 1OR to feed out the wide web 10, a slitter 30 which slits the wide web 10 into a plurality of webs 10*a* of a predetermined width, a winding section 40 which takes up the slit webs 1O*a* around a plurality of cores 42, a core cutter 50 which cuts a core material into a plurality of cores 41 in a predetermined length, and a core transfer means 60 which transfers the cores 41 from the core cutter 50 to the winding section 40.

The feed-out mechanism 20 comprises a support 21 and a roll holding member 23 which is mounted on the support 21 for rotation about a shaft 22 and holds one wide web roll 10R on each end thereof. When the wide web roll 10R on one end is consumed, the roll holding member 23 is rotated to bring the wide web roll 10R on the other end to the feed-out position. While the roll 1OR on said the other end is fed out, a new roll 10R is set on said one end.

The slitter 30 comprises upper and lower blade assemblies 31 and 32. The upper blade assembly 31 comprises a plurality of (nine in the illustrated embodiment) upper blades 31*a* (see FIG. 2) held in a blade holder (not shown) at predetermined intervals. The lower blade assembly 32 is substantially the same as the upper blade assembly 31 in structure. The number and the intervals of the upper blades 31*a* are set according to the number of the webs 10*a* to be slit from the wide web 10 and the width of each web 10*a*. The blades of the lower blade assembly 32 are set so that each lower blade is associated with one of the upper blades 31*a*. The upper and lower blade assemblies 31 and 32 are rotated respectively in the directions of arrows A and B in FIG. 2, and the wide web 10 is fed between the upper and lower blade assemblies 31 and 32 in the direction of arrow C, whereby the wide web 10 is slit into a plurality of (eight in the illustrated embodiment) narrow webs 10*a*.

A pass roll 33 which presses the wide web 10 to apply tension to the wide web 10 is disposed upstream of the blade assemblies 31 and 32 and an expander roll 34 is disposed downstream of the same.

Figure 3:
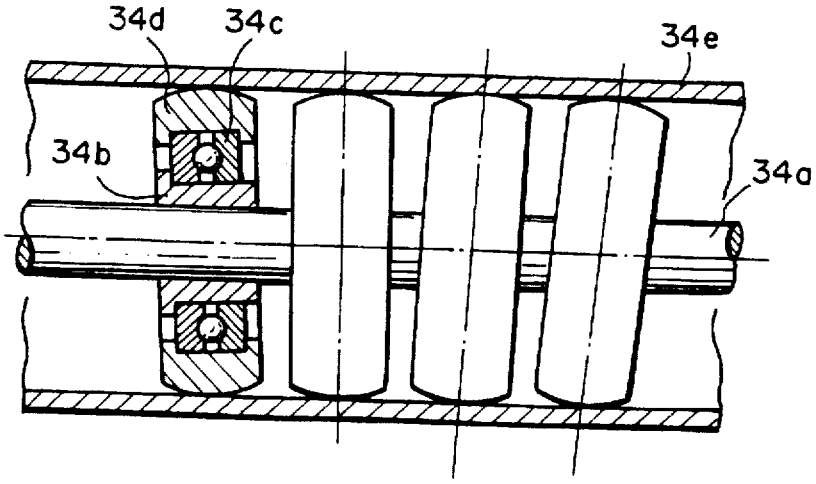
FIG. 3 is a horizontal cross-sectional view of the expander roll employed in the web winding apparatus.
Figure 4A:
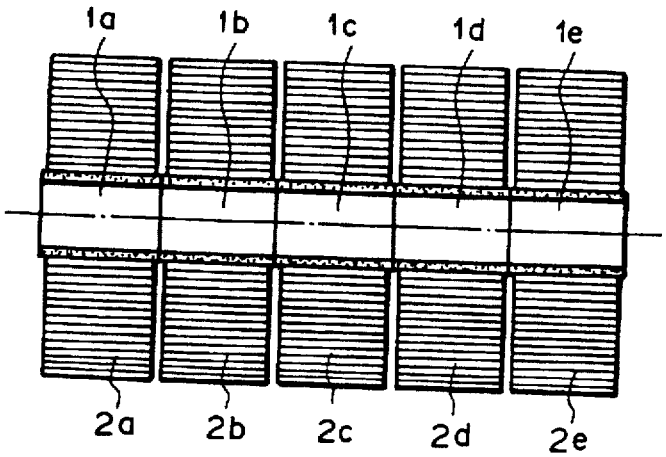
FIGS. 4A and 4B show different states of the webs taken up around the cores.
Figure 4B:
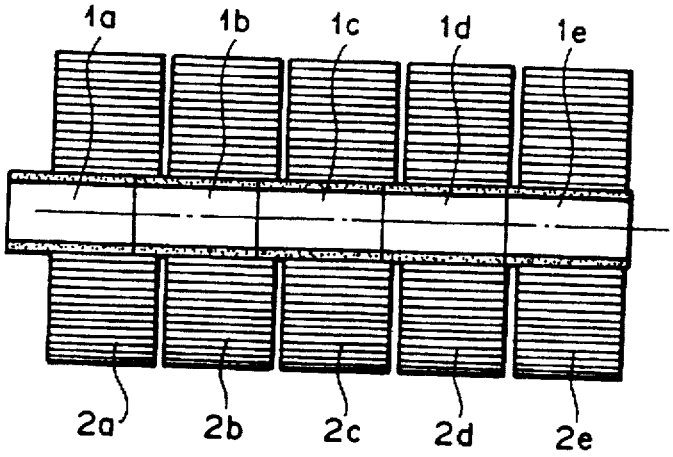

As shown in FIG. 3, the expander roll 34 comprises a main shaft 34*a*, a plurality of boss portions 34*b* fixed to the main shaft 34*a*, a collar 34*d* mounted on each of the boss portions 34*b* by way of a bearing 34*c* to be rotatable relative to the boss portion 34*b*, and an outer tube 34*e* of rubber which is fitted on the collars 34*d*. The boss portion 34*b* at the middle of the main shaft 34*a* is fixed to the main shaft 34*a* coaxially with the main shaft 34*a*. The boss portions 34*b* on opposite sides of the central one are fixed to the main shaft 34*a* with their axes inclined with respect to the main shaft 34*a*. The inclinations of the boss portions 34*b* are enlarged as the distance from the central boss portion increases.

While the narrows webs 10*a* slit from the wide web 10 are fed to the winding section 40 passing around the expander roll 34, the webs 10*a* are spread outward so that they are spaced from each other by virtue of the inclinations of the boss portions 34*b* or the collars 34*d* with respect to the main shaft 34*a*.

Figure 2:
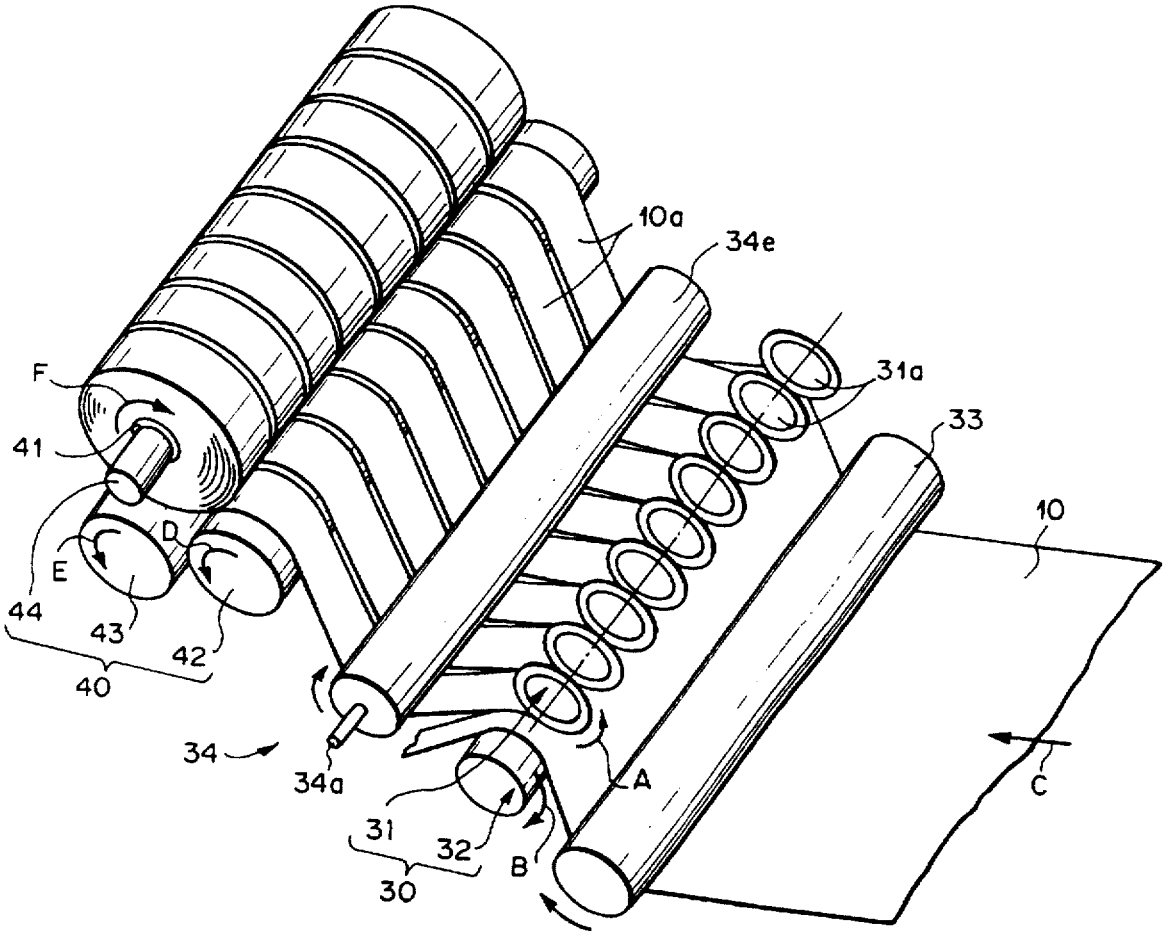
FIG. 2 is an enlarged perspective view of an important part of the web winding apparatus.

In the winding section 40, the narrow webs 10*a* are taken up respectively around the cores 41. As shown in FIG. 2, the winding section 40 comprises a pair of drive drums 42 and 43 which are rotated respectively in the directions of arrows D and E and a winding shaft 44 which is rotated in the direction of arrow F. A plurality of (eight in the illustrated embodiment) cores 41 are fitted on the winding shaft 44 side by side in the axial direction of the winding shaft 44. Prior to the winding operation, the leading end portions of the narrow webs 10*a* are fixed to the corresponding cores 41.

In response to rotation of the winding shaft 44, the narrow webs 10*a* are taken up around the cores 41 to form rolls on the cores 41. The rolls on the cores 41 are brought into contact with the drive drums 42 and 43 and are rotated also by the drums 42 and 43.

When the narrow webs 10*a* are taken up around the cores 41 over the entire lengths, the drive drums 42 and 43 and the winding shaft 44 are stopped, and the rolls 10B of the narrow webs 10*a* on the cores 41 are removed from the winding shaft 44 and conveyed in the direction of arrow G in FIG. 1. Then the rolls 10B are conveyed by a conveyor means (not shown) in the direction of arrow H and then in the direction of arrow J, for instance, to a wrapping section.

Preparation of the core 41 and supply of the cores 41 to the winding section 40 will be described, hereinbelow.

The core cutter 50 is disposed near the winding section 40. A long paper tube 41A from which the cores 41 are cut is supplied to the core cutter 50 one by one and placed in a predetermined position. The core cutter 50 is provided with a rotary blade 51 which is movable in the longitudinal direction of the long paper tube 41A and cuts the long paper tube 41A into a plurality of cores 41A in a predetermined lengths with the rotary blade 51.

The core cutter 50 and the winding section 40 are directly coupled together by the transfer means 60. For instance, the transfer means 60 may comprise a horizontal conveyor 61 extending in the longitudinal direction of the paper tube 41A, a horizontal conveyor 62 extending perpendicular to the horizontal conveyor 61, a bucket conveyor 63 which conveys the cores 41 upward and a horizontal conveyor 64.

The cores 41 cut by the core cutter 50 are put on the horizontal conveyor 61, for instance, by rolling them to the conveyor 61. Then the cores 41 are conveyed by the horizontal conveyor 61 and transferred to the horizontal conveyor 62. The cores 41 are thereafter transferred to the bucket conveyor 63 and transferred to the horizontal conveyor 64 from the bucket conveyor 63 at a predetermined level. The horizontal conveyor 64 brings the cores 41 into alignment with the winding shaft 44 near the winding shaft 44.

Then the cores 41 are successively fitted on the winding shaft 44 by a feed means not shown. When a predetermined number of (eight in the illustrated embodiment) cores 41 are fitted on the winding shaft 44, the transfer means 60 is stopped and the cores 41 fitted on the winding shaft 44 are fixed to the winding shaft 44 by chucking means (not shown).

The dimensions of the cores 41 of paper employed in the web winding apparatus of this embodiment are relatively apt to change under the influence of the temperature and humidity. Further the web winding apparatus is of a single-spindle type, in which a plurality of cores are supported on one spindle side by side, and inaccuracy in the length of the cores is apt to cause deterioration in appearance of the rolls 10B obtained or failure in the mechanisms such as the core chucking means.

However in the web winding apparatus of this embodiment, the cores 41 cut into a predetermined length by the core cutter 50 are directly transferred to the winding section 40 without staying in any other place, the cores 41 can be used before the dimensions of the cores 41 largely change due to influence of the temperature and relative humidity. Accordingly, the problems described above caused by inaccurate length of the cores 41, e.g., deterioration in appearance of the product 10B, failure in the chucking means and the like, can be overcome.

Further since the length of the cores 41 can be kept accurate, adjustment for ensuring regular winding of the web 10*a* can be eliminated or greatly facilitated.

In order to suppress influence of the temperature and humidity, the number of the cores 41 which can be loaded on the transfer means 60 at one time should be equal to the number of the cores which can be loaded on the winding shaft 44 at one time (eight in this embodiment). However for the reason described above, the transfer means 60 is in such a length that permits nineteen (slightly larger than double the number of the cores which can be loaded on the winding shaft 44 at one time) cores 41 to be loaded on the transfer means 60.

What is claimed is:

1. A web winding apparatus for taking up a web of a predetermined width and winding said web around a core of a predetermined length, said apparatus comprising:

a core cutting section which cuts said core into a plurality of cores of a predetermined length from a core material;

a slitter for cutting said web into a plurality of webs of a predetermined width and the slit webs in continuous lengths are taken up around said plurality of cores supported on one spindle side by side;

a winding section comprising a winding shaft on which said plurality of cores are horizontally disposed such that said slit webs are wound around said cores, respectively, by rotating said winding shaft; and a core transfer mechanism which directly couples the core cutting section to the winding section and loads and transfers said plurality of cores cut in the core cutting section to said winding shaft of the winding section, said core transfer mechanism comprising:

a first horizontal conveyor extending in a longitudinal direction of the core adjacent to the core cutting section;

a second horizontal conveyor extending perpendicular to the first horizontal conveyor in the same horizontal plane;

a bucket conveyor disposed vertically at one end of said second horizontal conveyor; and a third horizontal conveyor disposed at a predetermined level above said first horizontal conveyor and said second horizontal conveyor adjacent to said bucket conveyor;

wherein said plurality of cores cut in the core cutting section are transferred to the first horizontal conveyor and then transferred to the second horizontal conveyor from the first horizontal conveyor, and then said cores are loaded on the bucket conveyor from the second horizontal conveyor, the bucket conveyor conveying said cores upward to the third horizontal conveyor at said predetermined level, such that said cores are brought into alignment with the winding shaft in the winding section.

2. A web winding apparatus as defined in claim 1, in which said core is comprised of a paper tube.

3. A web winding apparatus as defined in claim 1 in which said core transfer mechanism is arranged so that the number of cores which can be loaded on the transfer means at one time is not larger than three to four times the number of said cores which can be loaded in the winding section at one time.

4. A web winding apparatus as defined in claim 1, in which said web comprises a photosensitive material.

* * * * *